US005396934A

United States Patent [19]

Moench

[11] Patent Number: 5,396,934

[45] Date of Patent: Mar. 14, 1995

[54] METHOD AND APPARATUS FOR INJECTING GAS INTO A BOTTLED FLUID

[76] Inventor: Thomas S. Moench, 2450 Abscher Rd., St. Cloud, Fla. 34771

[21] Appl. No.: 98,474

[22] Filed: Jul. 27, 1993

[51] Int. Cl.[6] ..... B01F 3/04; B65B 3/04

[52] U.S. Cl. ..... 141/5; 141/4; 141/37; 141/64; 141/114; 99/323.1; 99/323.2; 261/DIG. 7

[58] Field of Search ..... 141/4, 5, 11, 37, 64, 141/346, 382, 383, 114; 99/323.1, 323.2; 261/DIG. 7; 215/307; 220/303, 366

[56] References Cited

U.S. PATENT DOCUMENTS

| | | | |
|---|---|---|---|
| 3,557,986 | 1/1971 | Poole | 215/37 |
| 4,033,091 | 7/1977 | Saponara | 53/88 |
| 4,747,502 | 5/1988 | Luenser | 220/366 |
| 4,763,802 | 8/1988 | Johnston | 215/228 |
| 4,842,151 | 6/1989 | Scott | 215/228 |
| 4,867,209 | 9/1989 | Santoiemmo | 261/DIG. 7 |
| 4,899,896 | 2/1990 | Metzger | 215/228 |
| 4,934,543 | 6/1990 | Schmidt | 215/228 |
| 4,940,212 | 7/1990 | Burton | 141/5 |
| 4,947,739 | 8/1990 | Owen | 261/DIG. 7 |
| 5,010,928 | 4/1991 | Ballas | 141/64 |
| 5,282,495 | 2/1994 | Chamberlain | 141/4 |

*Primary Examiner*—Ernest G. Cusick
*Assistant Examiner*—Steven O. Douglas
*Attorney, Agent, or Firm*—Steven C. Stewart; James H. Beusse

[57] ABSTRACT

A method and apparatus for injecting $CO_2$ gas into a bottled liquid to carbonate or maintain carbonation in the liquid. A valved coupling having a conduit extending there through is screwably attached to a P.E.T. bottle substantially filled with liquid. The valve is depressed .while the bottle is squeezed to remove any excess air in the bottle. Regulated $CO_2$ gas is then fed through a connector that is attached to the coupling to carbonate the liquid. Once carbonated, the connector is removed while the coupling remains in place to maintain carbonation.

4 Claims, 1 Drawing Sheet

METHOD AND APPARATUS FOR INJECTING GAS INTO A BOTTLED FLUID

BACKGROUND OF THE INVENTION

This invention relates to a device for injecting gas into liquids, and more particularly, relates to a method and apparatus for carbonating or maintaining the carbonation of bottled beverages.

Carbonated beverages, such as sodas, sparkling water, beer, etc., are typically stored in a bottled container. The most common of these are one or two liter P.E.T. bottles made from plastic. The P.E.T. bottles have a screw-on cap that can be removed and replaced during use. However, if the cap is taken off the bottle, the carbonated beverage in the bottle will begin to lose its $CO_2$, carbonation or fizz.

In addition, as the beverage is consumed and removed from the bottle, a greater amount of air remains in the bottle in proportion to the amount of fluid in the bottle. Consequently, the gas in the liquid dissipates into the air in the bottle, even with the cap on the bottle, resulting in loss of carbonation.

Many prior devices have tried to slow the loss of carbonation in the liquid by increasing the air pressure in the bottle. However, because air is still in the bottle, carbonation is eventually lost.

Another drawback to having air in the bottled container is that for certain natural carbonated beverages, such as fruit juices and beer, air can cause these beverages to spoil, stale or degrade. Further, when air is present in the container, the beverage may be prevented from being re-carbonated.

When carbonating beverages, it is desirable to leave the cap on the container once $CO_2$ gas is fed into the container without permitting air to contaminate the beverage. It is then desirable to shake and refrigerate the beverage to dissolve all the $CO_2$ gas.

Many prior art devices do not permit easy injection of $CO_2$ gas into a bottle with subsequent easy removal of the injection device.

SUMMARY OF THE INVENTION

An object of this invention is to provide an improved method and apparatus for injecting gas into a bottled liquid.

Another object of this invention is to place a coupling on a bottle which permits air to be removed from a bottle while subsequently permitting $CO_2$ gas to be injected into the bottle to carbonate any liquids therein.

A further object of this invention is to disclose a process for carbonating beverages in a bottle while removing air from the bottle to prevent spoilage.

An additional object of this invention is to inject regulated $CO_2$ gas into a beverage in a P.E.T. bottle and to easily permit the beverage to be stored without the $CO_2$ escaping.

Yet another object of this invention is to carbonate beverages without requiring that the beverage be refrigerated and without requiring a gas diffuser.

It is also an object of this invention to carbonate beverages in a P.E.T. bottle using a device that can be easily removed and replaced to maintain carbonation.

These and other objects are provided with a method and apparatus for carbonating beverages. The apparatus includes a P.E.T. bottle having a nozzle at one end. The P.E.T. bottle is then substantially filled with the liquid with a small amount of air present in the bottle. A valve coupling is attached onto the nozzle. The valve coupling prevents gas from escaping from the bottle. The bottle containing the liquid is depressed simultaneously with the valve to permit substantially all of the air present in the bottle to be ejected from the nozzle and the valve coupling. Once the air has been ejected, the valve coupling is closed and a gas source is connected to the closed valve coupling. The bottle is then pressurized by attaching a $CO_2$ gas source to the closed valve coupling and injecting the gas through the valve coupling and into the bottle. In this manner, the liquid in the bottle is carbonated without any air exposure to the liquid. Thus, the longevity of the liquid is increased while maintaining liquid carbonation.

DESCRIPTION OF THE PREFERRED EMBODIMENTS

Figure 1:
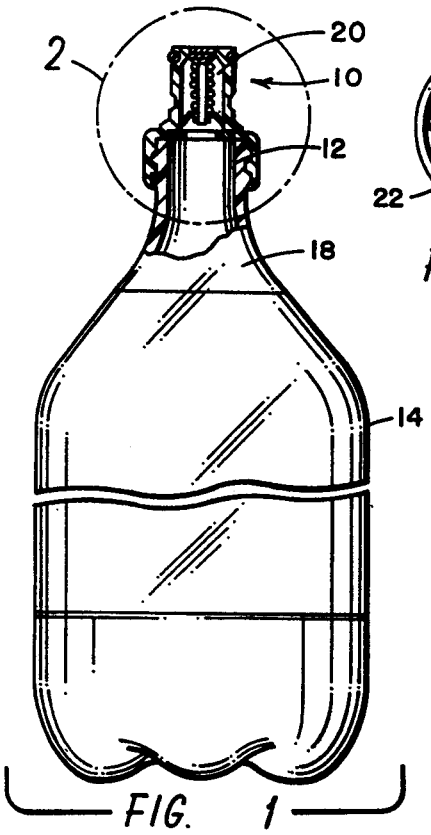
FIG. 1 is a partially sectioned view of the coupling connected to a P.E.T. bottle substantially filled with a liquid.

Referring to FIG. 1, there is shown a cylindrically shaped valved coupling 10 attached to a nozzle 12 of a P.E.T. bottle 14. P.E.T. bottle 14 is preferably substantially filled with any liquid 16. Preferable liquids include soda, juices, powdered mixes (Kool Aid), beer or other soft drinks. A small amount of air 18 is present in the top portion of the bottle 14. Valved coupling 10 is screwed on to nozzle 12 and contains a valve assembly 20.

Figure 2:
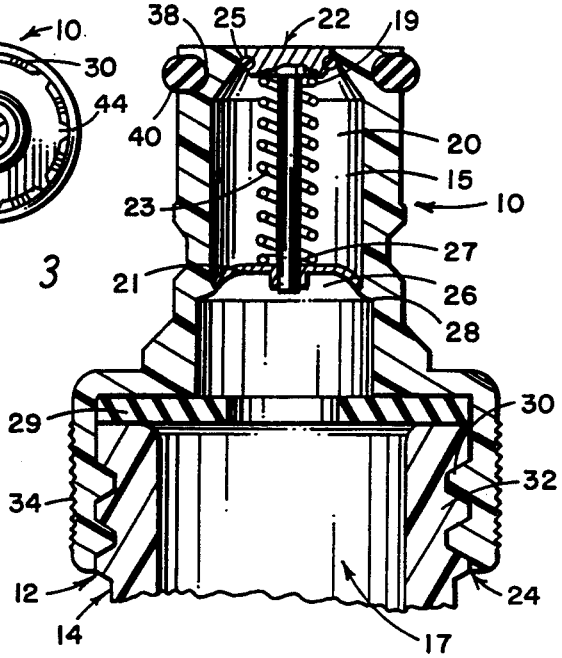
FIG. 2 is a sectioned view of the coupling along line 2—2 of FIG. 1.

Referring to FIG. 2, valved coupling 10 is preferably substantially cylindrically shaped having a valve end 22 and a threaded end 24. A conduit 26 extends through valved coupling 10 through which gas and liquid may pass. Conduit has a small chamber 15 adjacent the valve end and a large chamber 17 adjacent the threaded end. A conventional valve assembly 20 is positioned adjacent valve end 22. Valve assembly 20 includes a valve 19, three prong spider fitting 21 and a spring 23. Valve 19 has a surface that is coplaner with the end surface 25 of coupling 10.

Valve 19 is connected to a three prong spider fitting 21 with an aperture 27 extending therethrough. Valve 19 extends through aperture 27. Valve assembly 20 is forced in, a position to close conduit 26 positioned in conduit 26, surrounding valve 19, with spring 23. Spring 23 is-positioned in conduit 26 between valve end 22 of coupling 10 and fitting 21. A flange 28 is formed about the mid-portion of coupling 10 and encircles a portion of conduit 26. Spider fitting 21 is press fit over flange 28. A gasket 29 is positioned in conduit 26 on the adjacent threaded end of coupling 10. Gasket 29 prevents gas from leaking from bottle 14.

The threaded end 24 of coupling 10 has a plurality of threads 30 which are disposed on the outer wall of conduit 26 adjacent threaded end 24. Threads 30 mate with threads 32 on nozzle 12 of bottle 14. The outer perimeter of coupling 10 adjacent threaded end 24 is knurled 34 to permit easy turning of coupling 10 on nozzle 12.

The valve end 22 of coupling 10 contains an annular groove 38 which extends around the perimeter of coupling 10. Disposed in groove 38 is o-ring 40, which is preferably made from a flexible material such as rubber or plastic and provides a seal when a connector 50 (see FIG. 5) is inserted over coupling 10.

Figure 3:
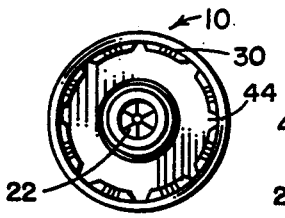
FIG. 3 is a bottom view of the coupling shown in FIG. 2.

Referring to FIG. 3, coupling 10 has a plurality of threads 30 extending around the outside perimeter of conduit 26 to mate coupling 10 with to the threads on bottle 14. A plurality of grooves 44 extend through threads 30 and rub longitudinally along coupling 10 parallel to conduit 26. Groove 44 permits gas to escape from bottle 14 when coupling 10 is removed from bottle 14. Groove 44 also prevents coupling 10 from projecting from bottle 14, when pressurized to eliminate serious injury to the user.

Figure 4:
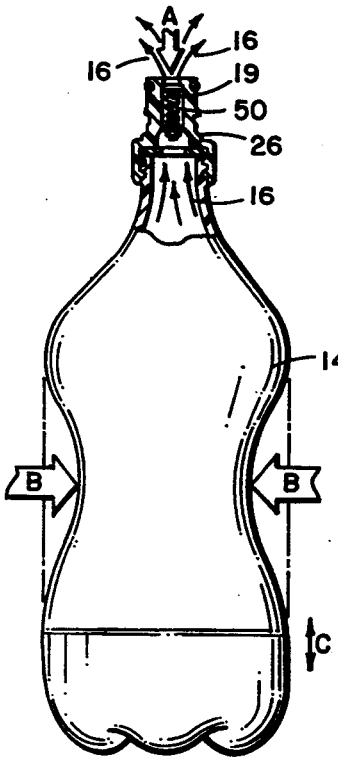
FIG. 4 is a partially sectioned view of the coupling shown in FIG. 1 with an open valve and P.E.T. bottle depressed along its sides.

Referring to FIG. 4, during operation of coupling 10, valve assembly 20 is opened by depression with the hand of the user. This depression is designated by "A". While the valve 19 is depressed the sides of bottle 14 are depressed. This side depression is designated by "B". The sides of bottle 14 are depressed to permit air 18 and a very small amount of liquid 16 to escape through conduit 26, nozzle 12, and out valve end 22. Once a small amount of liquid has escaped, valve assembly 20 is closed by releasing the area designated "A". In this manner, air is removed from container or bottle 14 to prevent spoilage.

Figure 5:
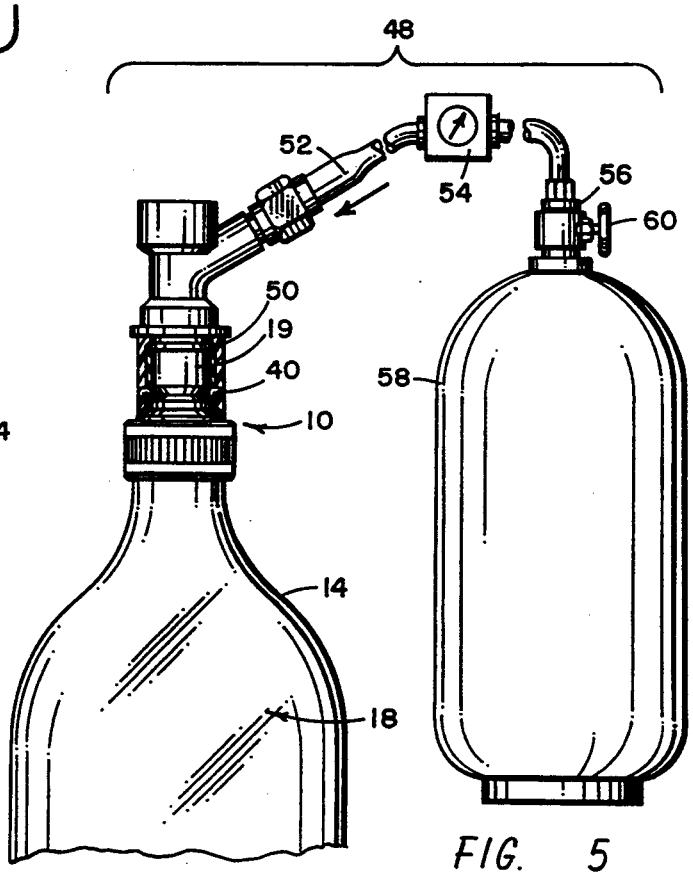
FIG. 5 is a diagram of the device shown in FIG. 1 attached with a connector to a regulated gas source.

Subsequently, referring to FIG. 5, a $CO_2$ gas source 48 is connected through coupling 10 to bottle 14. $CO_2$ gas source includes a connector 50 coupled with hose 52 through regulator 54 and regulator valve 56 to a canister 58. Preferably, canister 58 contains a $CO_2$ gas for carbonating any liquid in bottle 14. However, canister 58 may contain other gases such as nitrogen or oxygen, etc. to change the properties of the gas being injected into liquid 16. Connector 50, generally known as a gas socket, and is constructed by conventional means. One such connector 50 is Model No. PPL 372 SNB manufactured by Hanson, Carlton, Minn. Regulator 54 preferably maintains a pressure within P.E.T. bottle 14 of 30–40 psi so as not to create a substantial amount of pressure to break bottle 14.

Regulator valve 56 enables and disables gas coming from canister 58. Valve 56 is adjustable with handle 60 so that the gas exiting canister 58 is maintained within the predetermined 30–40 per square inch range.

Once air has been depleted from bottle 14 as described in connection with FIG. 4, $CO_2$ gas, from the source 48 is fed through coupling 10 and into P.E.T. bottle 14. Connector 50 has a pin when attached to coupling 10 forces valve 19 open. O-ring 40 forms a seal with connector 50 to prevent any gas from leaking along the outside perimeter of coupling 10.

Once $CO_2$ gas has been fed into bottle 14, the $CO_2$ source 48 is removed from the bottle 14. Next, bottle 14 is shaken, as designated by "C", to dissolve the gas within the liquid. The $CO_2$ source 48 is then reconnected and valve 56 is then opened again to supply more gas into bottle 14. This process is repeated over and over again until the outside of bottle 14 is hard to the touch.

Once all the gas has been inserted into bottle 14, connector 50 is removed from coupling 10 without any gas escaping from the bottle 14. To maintain carbonation, preferably bottle 14 is then placed in a refrigerated environment with the coupling 10 attached for 10–14 hours to permit all the $CO_2$ from the source 48 to remain in the liquid. After the gas has dissolved in the liquid the coupling 10 is removed and the liquid is poured from the bottle 14.

A reading by those skilled in the art will bring to mind various changes without departing from the spirit and scope of the invention. It is intended, however, that the invention only be limited by the following appended claims.

What is claimed is:

1. A method for preventing loss of carbonation or for increasing carbonation of a liquid stored in an elastic P.E.T. bottle, the method comprising the steps of:

providing a P.E.T. bottle having a nozzle at one end;

substantially filling the P.E.T. bottle with a liquid so that air is present in the bottle;

attaching an openable valved coupling that prevents gas from escaping from the bottle onto the nozzle;

simultaneously compressing the bottle containing liquid and opening the valved coupling to permit substantially all of the air present in the bottle to be ejected through the nozzle and the valved coupling as the volume of the bottle is reduced by such compressing step;

closing the valved coupling once the air has been ejected;

attaching a gas source to the closed valved coupling;

pressurizing the bottle by injecting gas from the source through the valved coupling and into the bottle after air has been ejected from the bottle; and removing the gas source from the bottle when the bottle is pressurized.

2. The method as recited in claim 1 further comprising the step of:

shaking the bottle to agitate the liquid to dissolve the gas in the liquid.

3. The method as recited in claim 1 further comprising the step of providing a $CO_2$ gas as the gas source.

4. A method for injecting gas into a liquid, the method comprising the steps of:

providing a P.E.T. bottle having a threaded nozzle at one end;

substantially filling the P.E.T. bottle with a liquid such that air is present in the bottle above the filled liquid;

providing a valved coupling having a shape that, when attached to the threaded nozzle, prevents gas from escaping from the bottle;

placing a valve assembly having a valve that opens and closes in said valved coupling;

screwably attaching the valved coupling with the valve assembly closed to the threaded nozzle;

simultaneously manually compressing the bottle containing liquid and manually opening the valve to eject substantially all of the air present in the bottle through the nozzle and the valved coupling;

closing the valve once the air has been ejected;

attaching a $CO_2$ gas source to the closed valved coupling;

opening the valve when the gas source is attached;

pressurizing the bottle by injecting $CO_2$ gas from the source through the opened valved coupling and into the bottle after air has been ejected from the bottle;

disconnecting the gas source from the valved coupling and closing the valve after the bottle has been pressurized;

shaking the bottle to dissolve the $CO_2$ gas in the liquid within the pressurized bottle; and screwably removing the valved coupling from the bottle after the $CO_2$ gas has dissolved to pour the liquid.

* * * * *